US006814630B1

(12) United States Patent
Tomasino

(10) Patent No.: US 6,814,630 B1
(45) Date of Patent: Nov. 9, 2004

(54) NO-CRIMP REUSABLE UNIVERSAL ELECTRICAL CONNECTOR

(75) Inventor: Guy Tomasino, Poplar Bluff, MO (US)

(73) Assignee: Swenco Products, Inc., Poplar Bluff, MO (US)

( * ) Notice: Subject to any disclaimer, the term of this patent is extended or adjusted under 35 U.S.C. 154(b) by 0 days.

(21) Appl. No.: 10/265,164

(22) Filed: Oct. 7, 2002

Related U.S. Application Data

(60) Provisional application No. 60/326,986, filed on Oct. 5, 2001.

(51) Int. Cl.[7] ..... H01R 11/09
(52) U.S. Cl. ..... 439/784; 439/805
(58) Field of Search ..... 439/784, 805, 439/863

(56) References Cited

U.S. PATENT DOCUMENTS

| | | | | | |
|---|---|---|---|---|---|
| 2,410,961 | A | * | 11/1946 | Carson | 439/708 |
| 2,959,766 | A | * | 11/1960 | Jacobsen | 439/863 |
| 2,967,289 | A | * | 1/1961 | Day | 439/805 |
| 3,229,240 | A | * | 1/1966 | Harrison, Sr. et al. | 439/692 |
| 3,466,595 | A | * | 9/1969 | Boutilier | 439/817 |
| 4,204,739 | A | * | 5/1980 | Shoenleben | 439/263 |
| 4,390,226 | A | * | 6/1983 | Hohn | 439/261 |
| 5,228,875 | A | * | 7/1993 | Swenson, Sr. | 439/784 |
| 5,695,369 | A | * | 12/1997 | Swenson, Sr. | 439/784 |
| 5,868,589 | A | * | 2/1999 | Swenson, Sr. | 439/784 |
| 6,250,955 | B1 | * | 6/2001 | Archuleta | 439/502 |
| 6,488,548 | B1 | * | 12/2002 | Tomasino | 439/784 |

* cited by examiner

*Primary Examiner*—Hae Moon Hyeon
(74) *Attorney, Agent, or Firm*—Jim Zegeer

(57) ABSTRACT

A plug-type connector in which the individual stripped wire ends coming into the connector, whether for the female element of the plug or for the prong male element of the plug, are secured without the use of any tools.

4 Claims, 5 Drawing Sheets

FIG.11A
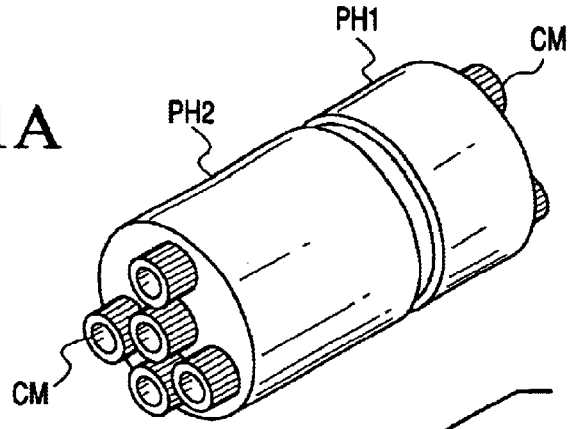
FIG.11B
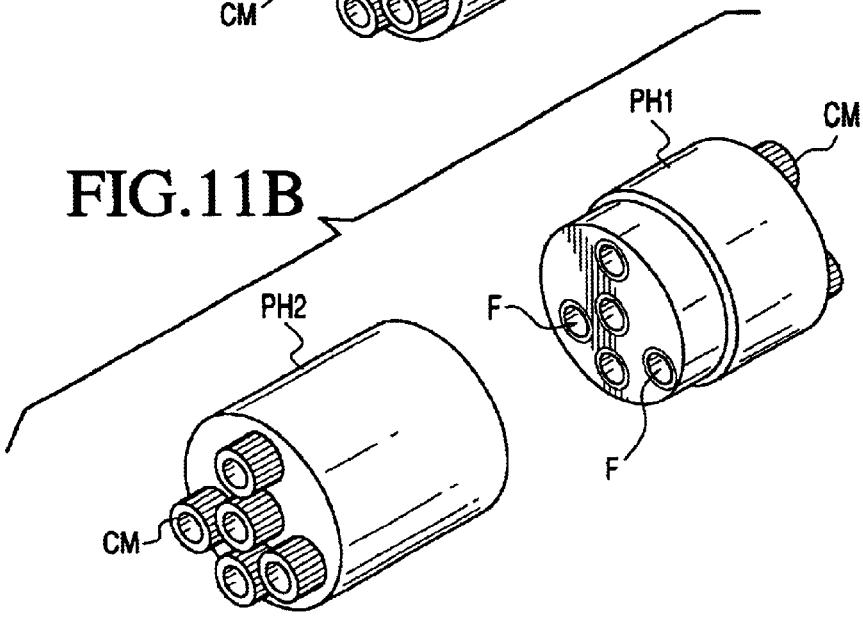
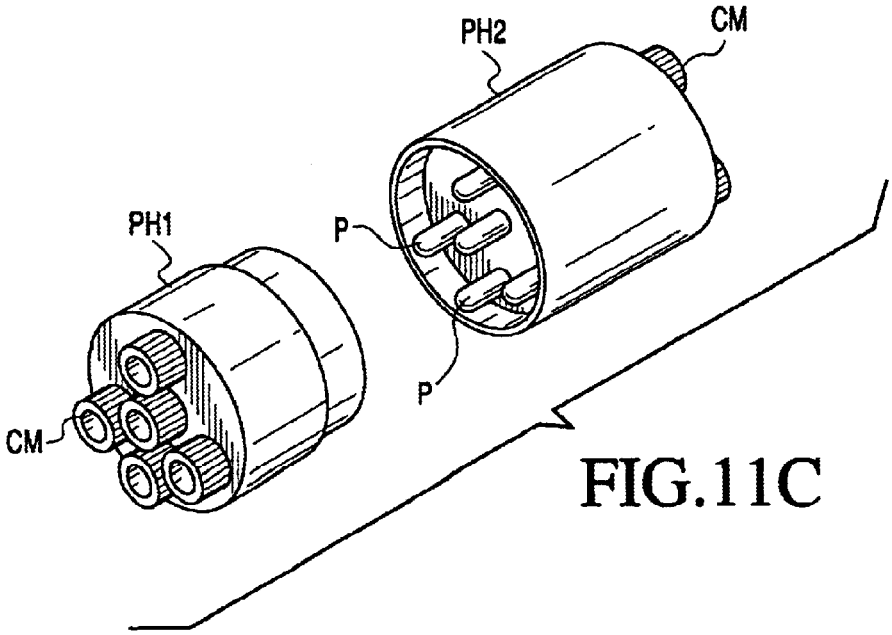
FIG.11C

NO-CRIMP REUSABLE UNIVERSAL ELECTRICAL CONNECTOR

REFERENCE TO RELATED APPLICATION

This application is the subject of provisional application Ser. No. 60/326,986 filed Oct. 5, 2001 and entitled MULTIPLE HARNESS, NO-CRIMP REUSABLE UNIVERSAL CONNECTOR.

BACKGROUND AND BRIEF DESCRIPTION OF THE INVENTION

The present invention relates to single or multiple wire plugs incorporating in a preferred embodiment, the positive wire locking features of U.S. Pat. Nos. 5,228,875, 5,695,369 and 5,868,589.

In the past, single or multiple wire plugs for wiring harnesses and the like have incorporated crimp connectors which require a crimping tool to make the electrical connection to conductive element in a plug (male or female). In a typical electrical plug, individual wires come into the plug and are either secured to a prong conductor element by a crimp-type connection or by a screw-type connection, or some other means which requires a tool to crimp the wire or a screwdriver to set the screw down.

The object of the present invention is to provide a plug-type connector in which the individual stripped wire ends coming into the connector, whether for the female element of the plug or for the prong male element of the plug, are secured without the use of any tools.

According to the invention, a single or multiple wire plug connector having non-conductive body members is provided in which the electrical connecting element between each two wires is comprised of a body member having one or more connection chambers and a electrically conductive connection element having, in a preferred embodiment, a bullet-shaped end through each connection chamber and a coupling end on the other end thereof. The coupling end may be either an electrical prong (male element) or a receptacle (female element). Each connection chamber is provided with internally threaded walls which coact with a wire clamping member. There is a clamp member for each individual wire, each clamp member having an externally threaded surface for threaded engagement with the threaded interior wall of the connection chamber. The clamp member also has a throughbore which is adapted to receive a wire end which is being connected to the bullet-shaped end of the connective member and to clamp the wire end in the connection chamber. The opposite end of the bullet is provided with either a female receptacle for receiving an electrical prong or a male prong for plugging into the electrical receptacle. For flat plugs, the clamp member of interior connectors, in one embodiment, is made slightly longer so as to be easier to grip between the fingers and clamp down on the wire.

In a second embodiment, instead of a bullet shape for the conductive element, a hollow, wire-receiving configuration is provided with a side aperture, and a ball is provided in the aperture. The ball fits in an aperture in a side of the conductive element and when the wire is put into the hollow end, the clamping member is turned to force the ball sideways into clamping engagement with the wire that has been fitted into the hollow bore.

Accordingly, the primary object of the invention is to provide an improved detachable single or multiple plug connector. Another object of the invention is to provide a single or multiple plug connector which is adapted to attach one or a plurality of wires to a like number of wires wherein no tools are required to make the wire connection.

The invention features a conductive element for use in forming an electrical plug coupling unit comprising a conductive body member having a first end and a second end, said first end being shaped to serve as a crimp-free electrical connector and said second end being shaped to form one of the following: (a) a male prong member or (b) a female prong member adapted to receive a correspondingly shaped male prong member or another of said conductive elements. In one embodiment, one end is shaped as a wire-splaying end and wire clamp surface, and in another embodiment said first end has a bore coaxially located in the center thereof and a transverse aperture, a ball seated in said transverse aperture, said ball being adapted for camming by a threaded camming member against a wire inserted through said bore and thereby clamping same therein.

The invention further features an electrical plug element comprising in combination a non-conductive body member and a plurality of conductive elements as described above, there being at least one male prong member and at least one female prong member therein.

BRIEF DESCRIPTION OF THE DRAWINGS

The above and other objects, advantages and features of the invention will become more clear and apparent when considered with the following specification and accompanying drawings wherein:

FIG. 11A is perspective sectional view of the five-pin plug assembly for heavy-duty trailer harnesses, FIG. 11B is an exploded end view thereof, and FIG. 11C is an exploded view from the opposite end thereof,

DETAILED DESCRIPTION OF THE INVENTION

Figure 3:
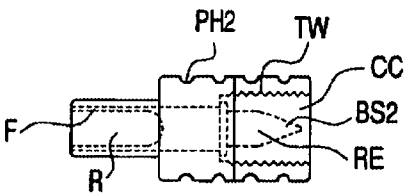
FIG. 3 is a side sectional view of the female portion of the four-wire connector plug.
Figure 4:
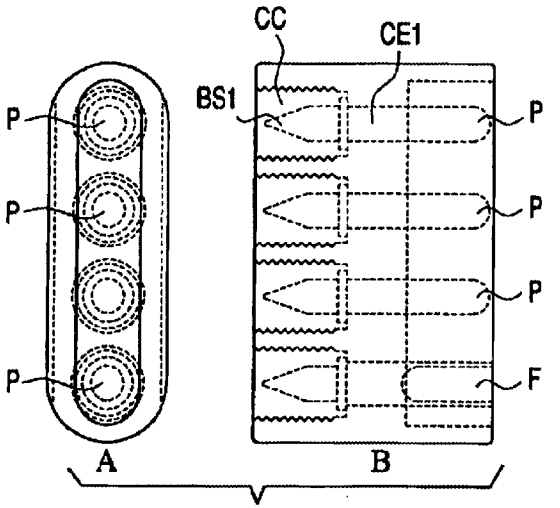
FIGS. 4A and 4B show end and sectional view of the four-wire connector plug.
Figure 5:
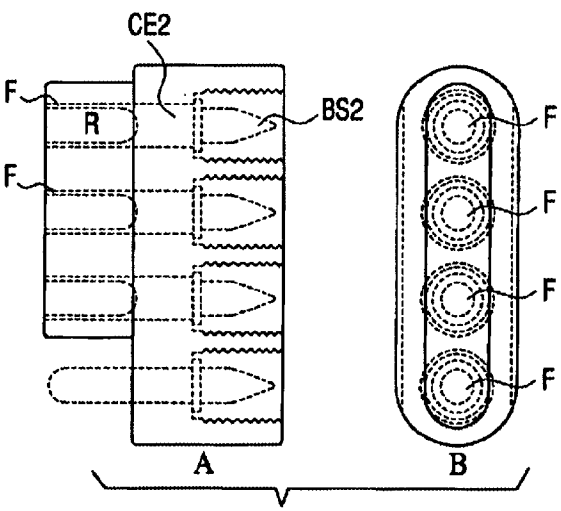
FIGS. 5A and 5B are end and side views of the four-wire connector plug.
Figure 6:
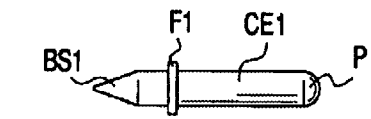
FIG. 6 is an embodiment of the male prong-/bullet-type conductive element.
Figure 7:
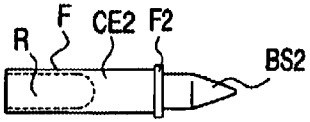
FIG. 7 is a side elevational view of the female prong-type conductive element.

In a first embodiment of the invention, as illustrated in FIGS. 1–8, the one end of the conductive element CE1, CE2 in each molded plug assembly half PH1, PH2 is conically- or bullet-shaped BS1, BS2 (as in the above referenced patents) and the connection chamber CC has threaded wall TW which coacts with an externally threaded male clamp member CM having a throughbore T with a complementary shape CS to the bullet-shaped conductive element so that wires passing therethrough are splayed on the bullet- or conically-shaped end BS conductive element, and when the male clamp element CM is screwed in, it clamps the wires therebetween. In essence, the teachings of U.S. Pat. Nos. 5,228,875, 5,695,369 and 5,868,589 are adapted for use in the embodiment of the present invention. Note that each conductive element CE has a central flange F1, F2 which serves as a stop for the molding of the conductive element into the non-conductive plug body PH. The opposite end is provided in one instance with a prong P which serves as a male element of a plug connector (see FIGS. 2, 4A, 4B, and 6), and in the opposite end a female element F is formed. On the female end F of the assembly, the receptacles R for the prongs are encased in a stabilizing non-conductive plastic plug body member portion which seats in a receptacle formed in the right end of the embodiment shown in FIG. 4. The encasement provides stability and strength to the receptacles in the conductive elements. Referring now to FIGS. 3, 5 and 7, and particularly to FIGS. 3 and 7, the conductive element has a bullet-shaped right end BS, and an open receptacle R in the opposite end.

Figure 8:
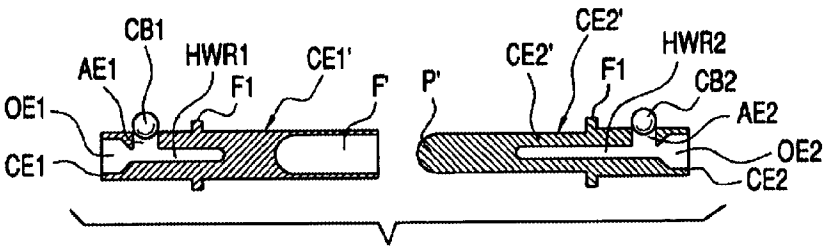
FIG. 8 is a diagrammatic illustration of the invention with the ball clamp design.
Figure 9:
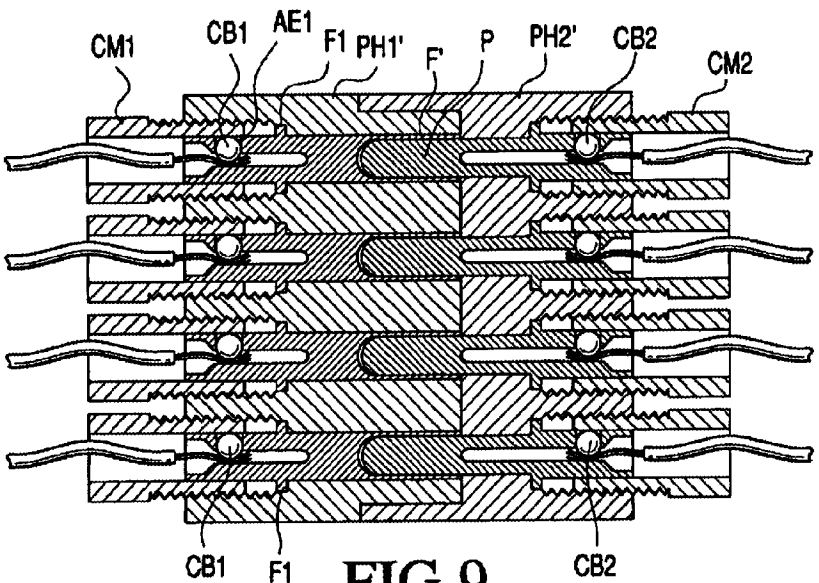
FIG. 9 is a sectional view of ball clamp design for a four-wire connector.

In the embodiment shown in FIGS. 8 and 9, the bullet-shape for the conductive element CE1', CE2' is replaced with a hollow wire-receiving configuration HWR1, HWR2 with the wire-receiving wire sized to receive the largest size wire which this embodiment is designed. In other words, it is slightly wire-size specific. An aperture AE1, AE2 is provided in one sidewall for receiving clamp balls CB1, CB2. In the illustration of FIG. 8, the left female prong element and the right male prong element are the same as in the previous embodiment. The two separate conductive elements are molded into plugs in a similar manner to that illustrated in FIGS. 2–5. In the sectional view shown in FIG. 9, each wire has been inserted into the wire-receiving bore. (Note that the wire-receiving bores HWR1, HWR2 are enlarged at the outer ends thereof OE1, OE2 so as to make it easier to guide the wire into the bores.) Each wire is individually guided into the bores, and clamp members CM1, CM2 are threadably engaged with the connection chamber interior walls. By virtue of the threaded engagement, turning of the clamp members CM in a direction to screw them in, causes the ends of the clamp members to engage the clamp ball CB and force the clamp balls CB into tight snug clamping engagement with the wires.

Figure 1:
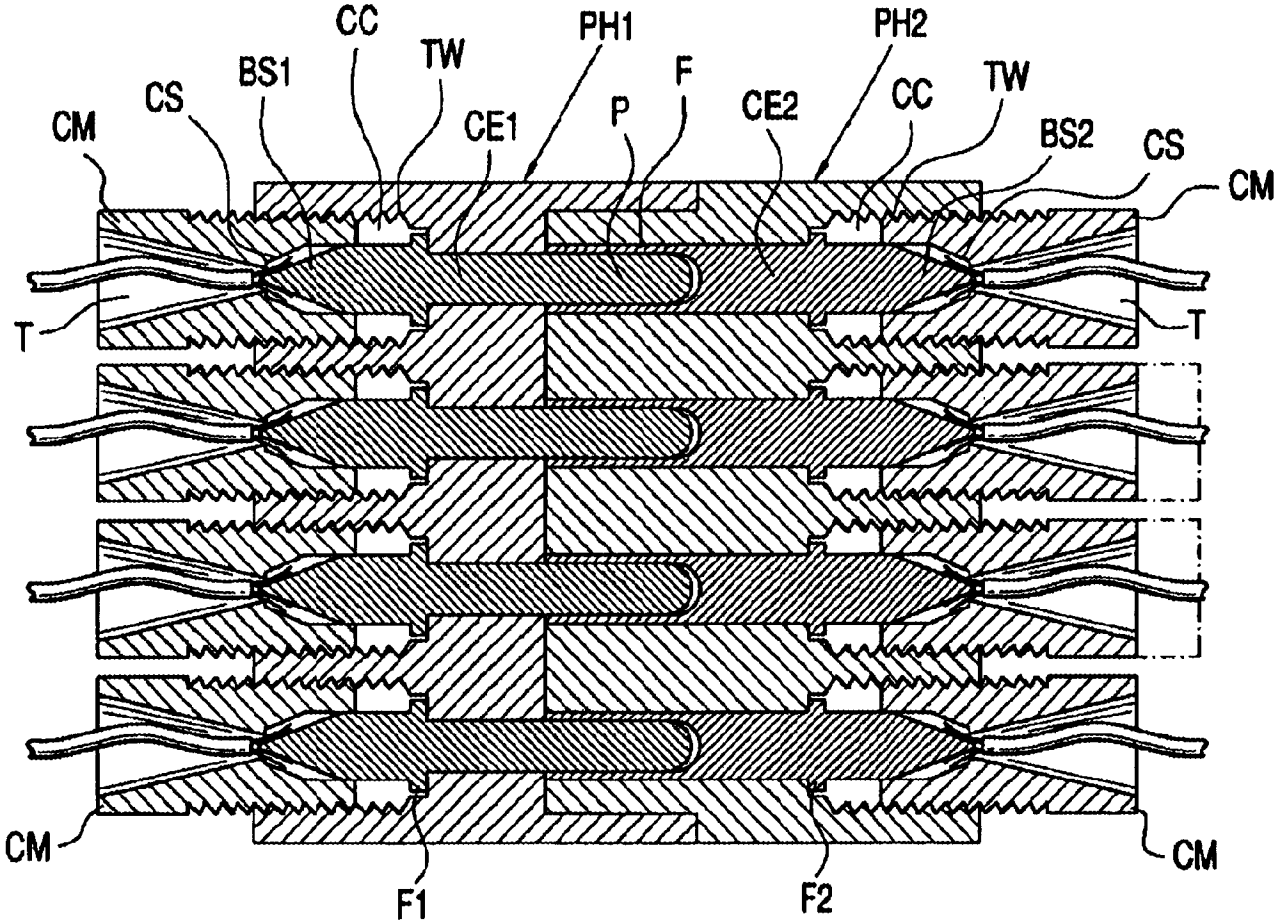
FIG. 1 is a sectional view illustrating the invention as applied to a four-wire connector plug assembly in use with wires clamped in place.
Figure 2:
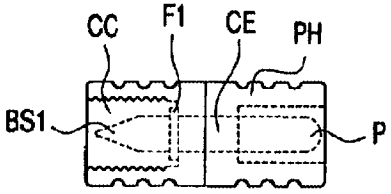
FIG. 2 is a side sectional view of the male portion of a four-wire connector.

In each of these embodiment, particularly the flat embodiment, where the interior clamping members are in a compact arrangement, the ends of the clamping members may be extended or enlarged as shown in dotted lines in FIG. 1, right-hand end, so as to provide easy gripping of same after the outermost wires have been clamped.

The plug bodies PH1, PH2 and the clamping members CM are non-conductive molded plastics. In each of the embodiments, the female prong elements are encased in plastic, and a sheet overlap on the plugs. It will be noted in connection with the embodiment shown in FIGS. 4 and 5 that the lower elements are reversed in that the male prong element is on the plug half to the right and the female conductive element is on the left-hand side. This serves as a key to avoid improper plugging of two plug elements together.

Figures 10A, 10B, 10C:
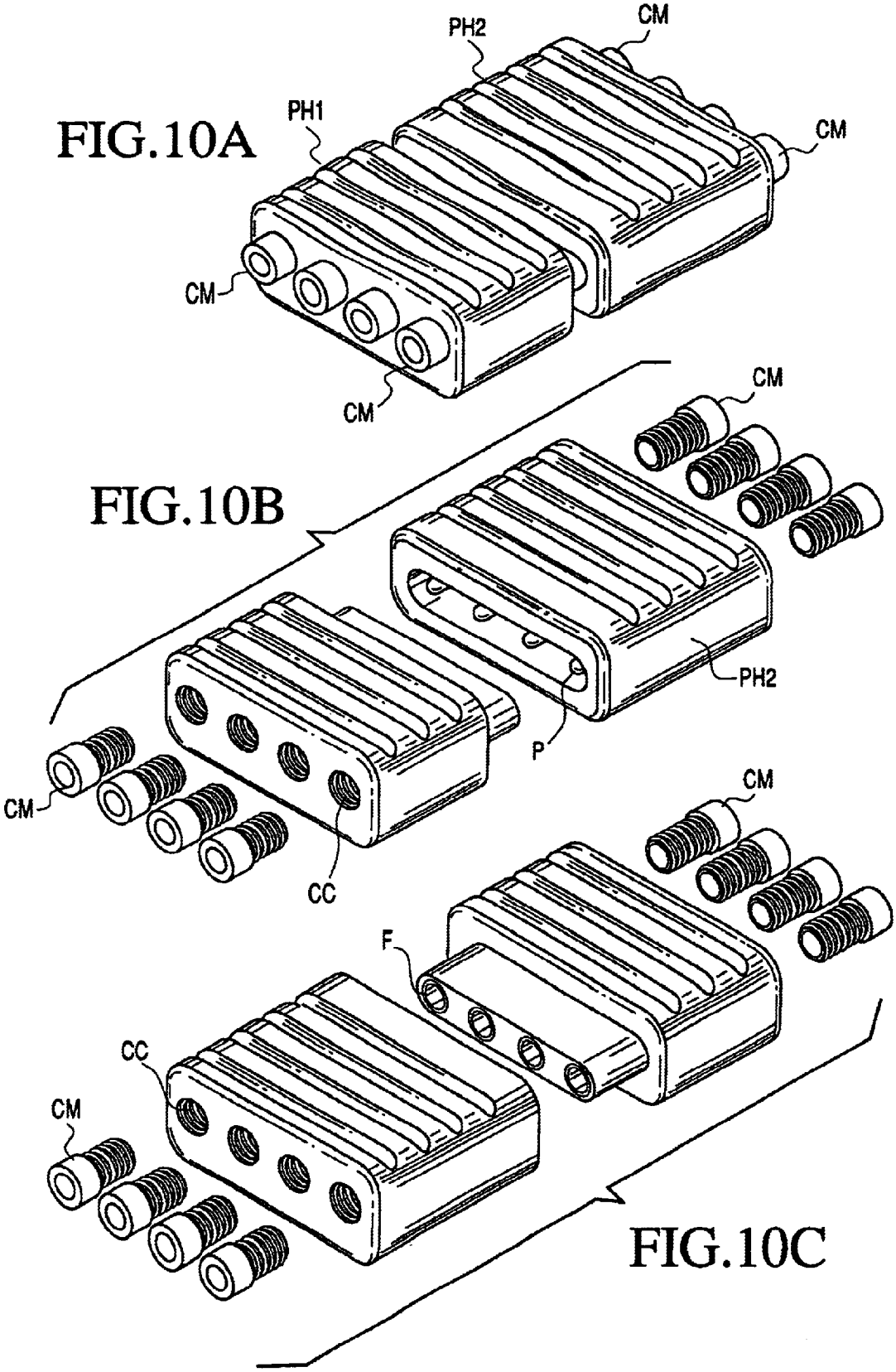
FIG. 10A is a perspective view of a four-wire plug assembly.
FIG. 10B is an exploded view thereof from one end thereof.
FIG. 10C is an exploded view from the opposite end thereof.

It will be appreciated that not all of the positions or places for wires need be used. In some embodiments, one of the wires may serve as a ground wire. In other embodiments, the non-conductive plug bodies may be round (FIGS. 11A–11C) or square or flat (FIGS. 10A–10C).

While the invention has been described in relation to preferred embodiments of the invention, it will be appreciated that other embodiments, adaptations and modifications of the invention will be apparent to those skilled in the art.

What is claimed is:

1. A no-crimp multi-wire plug assembly comprising:

a non-conductive body member having a plurality of connection chambers formed therein, one connection chamber for each wire, respectively, each connection chamber having an internally threaded wall and a conductive element positioned centrally in said connection chamber and having a splaying end in said connection chamber, each said conductive element having an opposite end to said splaying end and said opposite end being formed selectively as a male prong or a female, prong-receiving member, a portion of each conductive element embedded in said non-conductive body member, a plurality of male clamp members having external threads for threaded engagement with said internally threaded wall and a throughbore with a complementary shape to said splaying end so that wires passing through said throughbore are sprayed on the splaying end and clamped to said splaying end, respectively.

2. The no-crimp multi-wire plug assembly defined in claim 1 wherein in said body member is flat.

3. The no-crimp multi-wire plug assembly defined in claim 1 wherein said body member is round.

4. A no-crimp multi-wire plug assembly comprising:

a non-conductive body member having a plurality of connection chambers formed therein, one connection chamber for each wire, respectively, each connection chamber having an internally threaded wall and a conductive element positioned centrally in said connection chamber and having a splaying end in said connection chamber, each said conductive element having an opposite end to said splaying end, said opposite end being formed selectively as a (1) male prong or (2) a female prong-receiving member, each said conductive element being molded in said non-conductive body member, each said conductive element having a central flange which serves as a stop for the molding of the conductive element into said non-conductive body member, and a plurality of male clamp members having external threads for threaded engagement with said internally threaded wall and a throughbore with a complementary shape to said splaying end so that wires passing through said throughbore are splayed on the splaying end and clamped to said splaying ends, respectively.

* * * * *